United States Patent [19]

Allard

[11] Patent Number: 4,516,657

[45] Date of Patent: May 14, 1985

[54] SOUND SUPPRESSION OF ENGINE NOISE

[76] Inventor: Edward F. Allard, 7830 Greeley Blvd., Springfield, Va. 22152

[21] Appl. No.: 428,073

[22] Filed: Sep. 29, 1982

[51] Int. Cl.[3] ..... F01N 1/02; F01N 1/24

[52] U.S. Cl. ..... 181/204; 181/224; 181/225; 181/256

[58] Field of Search ..... 181/175, 198, 200, 202–205, 181/224, 225, 256

[56] References Cited

U.S. PATENT DOCUMENTS

| | | | |
|---|---|---|---|
| 2,720,276 | 10/1955 | Droeger | 181/203 |
| 3,989,415 | 11/1976 | Van-Hee et al. | 181/224 X |
| 4,068,736 | 1/1978 | Dean et al. | 181/224 |
| 4,264,282 | 4/1981 | Crago | 181/202 X |
| 4,385,678 | 5/1983 | Cederbaum | 181/204 |

FOREIGN PATENT DOCUMENTS

| | | | |
|---|---|---|---|
| 1577688 | 10/1969 | France | 181/202 |

*Primary Examiner*—Benjamin R. Fuller

[57] ABSTRACT

A method and apparatus for suppressing sound generated by engines or other noise sources, by utilizing at least two acoustical encasements separated by an air channel with air being drawn through the air channel to provide intake air to the noise source. Sound leaks through the intake vent are attenuated by the air channel. Entrainment devices or an auxillary fan may be used to compensate for loss of air intake due to pressure losses through the air channel. Also, the use of entrainment allows for a smaller exhaust vent which reduces the opening ratio in the encasement, thus reducing sound leaks through the exhaust vent. Additionally, sound absorbing or attenuating materials are placed inside the intake air channel, thus suppressing the sound emanating from the noise source. Also, the exhaust vent is lined with proper absorbing materials to further reduce sound coming from the noise source. Furthermore, the inside encasement is substantially isolated from the outside encasement.

5 Claims, 7 Drawing Figures

SOUND SUPPRESSION OF ENGINE NOISE

BACKGROUND OF THE INVENTION

1. Field of the Invention

This invention relates to sound and more particularly to the suppression of noise generated by equipment such as, engines, generators, fans, compressors, etc.

2. Description of the Prior Art

It is well known that engines, compressors, fans, etc. can generate such noise that normal conversation near them is essentially impossible. Furthermore, such loud noise can impair hearing and cause phychological effects that reduce the efficiency of a workman. As a result of the findings from research in this area of technology, great interest is now being shown in various techniques for regulating sound emissions from a wide variety of operating equipment. Since man would benefit from the noise reduction of operating equipment, a measure of sound, weighted to the response of the human ear, was developed. The weighted scale is referred to as the "A" scale. The noise level is measured in decibels, weighted to the A scale and called dBA. Various experiments have been performed to determine the dBA values for different noise conditions. It was found that 130 dBA was the threshold of pain. A value of 50 dBA was found to be the average level for office conversation. Since it was necessary to drop the sound level of field equipment down to 50 dBA, the Environmental Protection Agency issued a temporary goal of 75 dBA for field equipment with an ultimate goal of 65 dBA. It is to the 65 dBA level and lower that this invention disclosure is directed.

Several journals have published the results of acoustical suppression of operating engines. These results used the standard techniques of employing acoustical materials, of designing special mufflers, of designing silencers, and of using various vibration isolators. A large industry has developed around sound suppression, providing new materials and test data on the materials. A review of the literature shows that the materials and techniques of sound suppression center mainly around buildings and operating equipment found in buildings. It is relatively easy to suppress noise sources in a building because there is not a weight or volume restriction in general. In fact, one could build a room around a noisy engine if need be. The suppression problem is more severe for those noise sources that are in the field, such as an engine-generator set or compressor.

One of the major difficulties in acoustically suppressing an operating engine is a resultant engine overheating problem. If an engine is completely encased so that no noise can escape, the engine can overheat easily. If holes are made for engine intake air and exhaust air, then sound can escape through these holes. Designers have used mufflers, silencers, curved ducts, new materials and a variety of other techniques to suppress some engines. Published results show that these techniques have suppressed some engines (air compressors) down to 72 dBA. Significantly lower values have not been published to the best of this inventor's knowledge. The military has developed sound suppressors for military engine-generator sets, but at the expense of heating up the surface of the sound suppressor. For reasons other than sound, a hot surface surrounding an engine-generator set is not advantageous from a military viewpoint as it can easily be detected by state-of-the-art thermal viewers.

BRIEF DESCRIPTION OF THE DRAWINGS

FIG. 1(*b*) shows a front view of intake air entering through a top slot, passing through the space between the enclosures and entering the inner chamber through slots in the inside enclosure;

FIG. 2(*b*) shows a fan or blower assisting the exhaust gases by supplying needed pressure to overcome the back pressure caused by the 180° turn. The 180° turn provides excellent sound suppression when the inside walls are lined with appropriate suppression material;

FIG. 3(*b*) shows the air ejector drawing in air into the inner chamber. This air helps to prevent overheating in the inner chamber;

DESCRIPTION OF THE PREFERRED EMBODIMENTS

Figure 1:
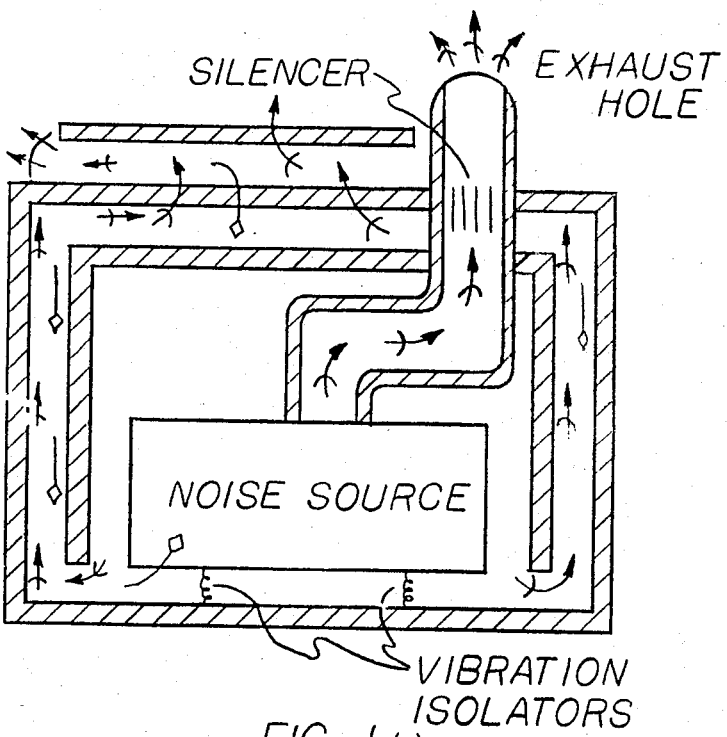
FIG. 1(*a*) shows a side view of an acoustical double enclosure. Air is drawn in from the top, passes through the space between the enclosures and enters the inner chamber through slots in the inside enclosure. The exit path for all exhaust gases goes from the noise source through a lined duct and silencer.
Figure 1:
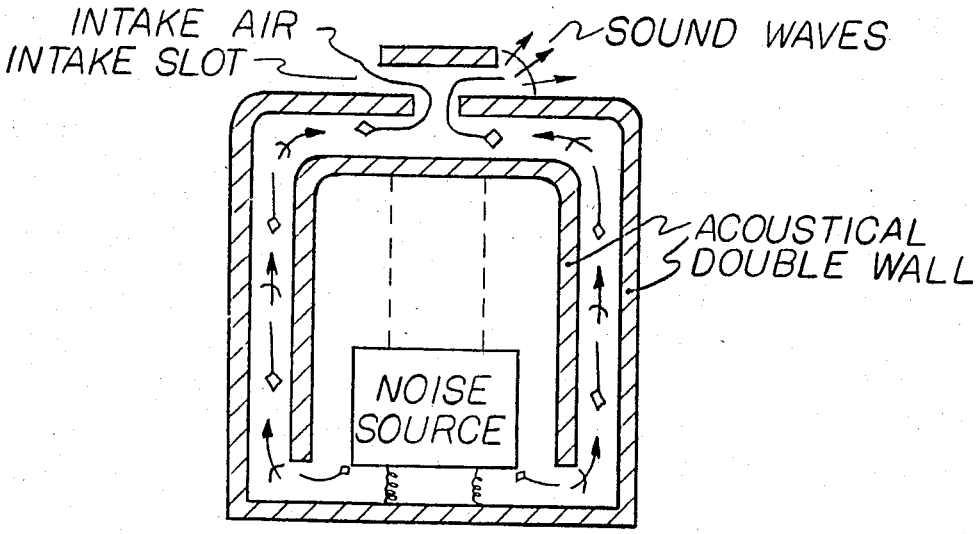

This invention may perhaps be best understood by making reference to the drawings. The use of two or more encasements with air spaces in between has the advantage of suppressing low acoustical frequencies. The inventor's own experiments, tests and measurements on engines show that considerable acoustical energy is found in the frequency range from 31.5 Hz to 500 Hz. Laboratory data show that several acoustical materials can suppress the frequencies above 500 Hz down below 50 dB but do not do an effective job below 500 Hz.

Published data show that the attenuation of sound, by encasing the sound source, is a function of the percentage of openings in the encasement. An encasement could have an actual attenuation of 60 dB for no holes in the encasement and a value of 25 dB for 50% opening. Therefore, it is very important to reduce the percent of opening. The basic invention visualized herein uses a very narrow slot, lined with acoustical material, as the intake vent to the inside volume where the noise source is located. This narrow slot reduces the opening ratio. The use of entrainment devices or fans inside the encasement, draws more air through the intake slot and this helps to cool the noise source. Additionally, entrainment devices permit the use of a small exhaust vent which reduces the opening ratio, thus decreasing the sound leak through the exhaust vent.

It is well known that acoustical energy can be absorbed and turned into heat energy by acoustical materials. The amount of absorption of a material depends on its physical structure and its thickness. Polyurethane can have an absorption coefficient of 0.04 at 200 Hz for $\frac{1}{4}$ inch thickness and a value of 0.20 for a 1 inch thickness. In addition, the absorption coefficient for the frequencies below 500 Hz can be significantly increased by a proper choice of facing for the walls of the encasement. A more dramatic absorption effect can be obtained by using a thin metal sheet with holes. By properly selecting the number and size of holes, it is possible to resonately absorb certain frequencies. Therefore, it is possible to insert into the intake air channel a thin metal sheet with properly selected holes to selectively absorb certain frequencies from the noise source. This is particularly attractive for the absorption of low frequencies.

Materials which are good absorbers are not good reflectors of acoustical energy. The best acoustical suppressor would be an encasement with no holes that reflects all sound inside the encasement and permits no sound to penetrate outside. This is not practical for field operating equipment. Therefore, a combination of absorption and attenuation is used for suppression. "Sandwich" materials that combine absorption and attenuation are the most practical materials for suppression. For example, a typical sandwich may be compared to two layers of polyurethane separated by a thin sheet of lead. The utilization of two enclosures of sandwich material, separated by an air space has the advantage of significantly increasing the total absorption coefficient for frequencies below 500 Hz. For example, 1 inch of glass fiberboard can have an absorption coefficient of 0.03 at 125 Hz. With a 2 inch air separation, this value can be increased to 0.17.

By properly selecting the materials, facing, geometry, resonate absorbers and air space between the two encasements of this invention, the attenuation coefficient at frequencies below 500 Hz can be dramatically improved. The attenuation of frequencies above 500 Hz is easily attenuated by the same materials. Therefore, acoustical suppression below 65 dB is assured and suppression below 50 dB is visualized.

As previously noted, the prevention of engine overheating is most important and no acoustical suppression technique can be used if the technique overheats the engine. The inventor's data show that the double encasement does not overheat engines as long as fans, injectors or other entrainment devices are utilized. Auxiliary fans are the most useful but drain power from the engine. If the draining of power is of no concern, fans can be used to great advantage. The use of air injectors not only helps to draw in additional air but cools the exhaust gas. A good injector design can entrain over 10 times the amount of exhaust gas and thereby cool the exhaust gas and exhaust pipe. This eliminates the safety problem of hot pipes and gases.

FIG. 1*a* shows the double encasement of this invention. Intake air is drawn through a narrow slot on the top of the outside encasement as shown in FIG. 1*a*. Sound from the noise source must travel through the narrow channel separating the two encasements, and exit through the slot. The attenuation of sound along this path is very high because of the path length and curvature of the walls. FIG. 1*a* shows the exit or exhaust vent. All exhaust gases and engine cooling air exit through this hole. The smaller the hole, the better the attenuation of sound. This hole has a silencer built into it. The exit duct has two bends with acoustically absorbing material on the inside surface. The combination of the suppressed duct and silencer suppresses the sound in the exhaust hole. The noise source itself is vibrationally isolated from the bottom of the outside encasement. FIGS. 1*a* and 1*b* show that intake air surrounds the entire inside encasement. Sound must travel through this channel.

Figure 2A:
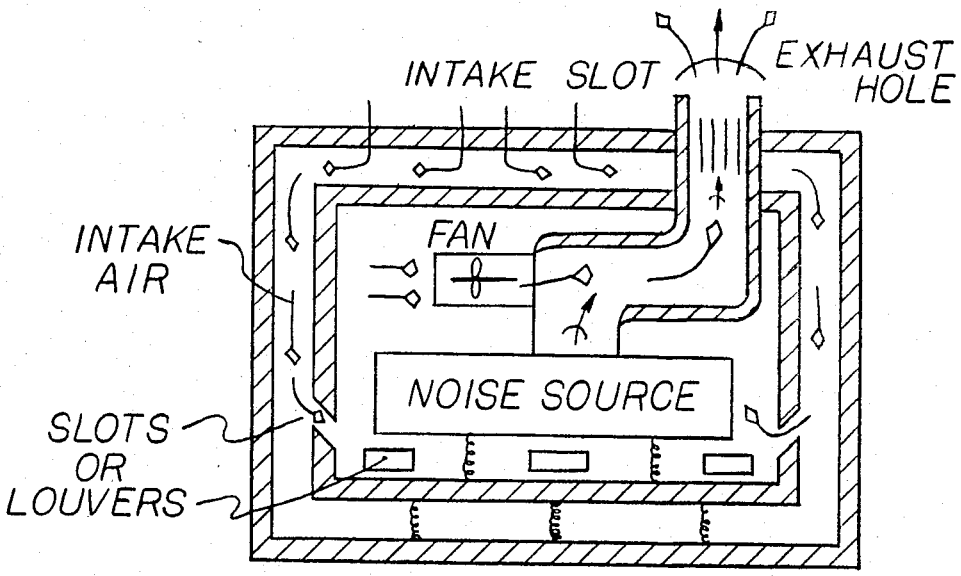
FIG. 2(*a*) shows a double enclosure that vibrationally isolates the noise source and vibrationally isolates the inside enclosure from the outside enclosure. Additionally, a fan or blower is used to force the exhaust gases out through the exit port.
Figure 2B:
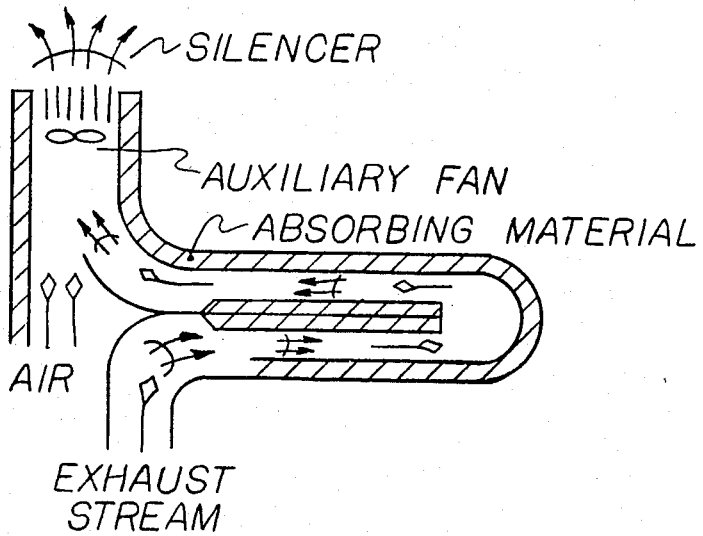

FIG. 2*a* shows a design for a small opening ratio. The auxiliary fan aids in drawing intake air through the louvers. This helps the cooling of the noise source. In addition, the fan permits the use of a small exhaust hole that helps attenuate the sound leaving the encasement. Furthermore, the fan mixes cooler air into the exhaust stream, thus lowering the exhaust gas temperature. The noise source is vibrationally isolated from the inside encasement and the inside encasement is isolated from the outside encasement. Clearly, this design can suppress the sound level down to very low levels by increasing the fan capacity and reducing the opening ratio as long as the fan itself does not contribute to the noise. FIG. 2*b* shows an auxiliary fan in the exhaust vent. The vent is designed to provide a 180° turn for the sound waves. A 180° turn could add non-acceptable back pressure in the exhaust stream. The auxiliary fan provides a make up pressure for the 180° turn and provides the necessary pressure to draw intake air through the louvers. The use of this fan assisted 180° turn can suppress the sound significantly and cool the exhaust stream.

Figure 3:
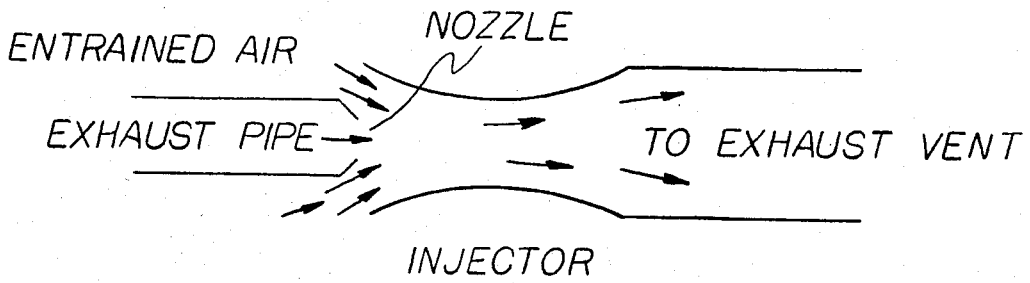
FIG. 3(*a*) shows an air ejector that can be used to draw additional air into the inside chamber.
Figure 3:
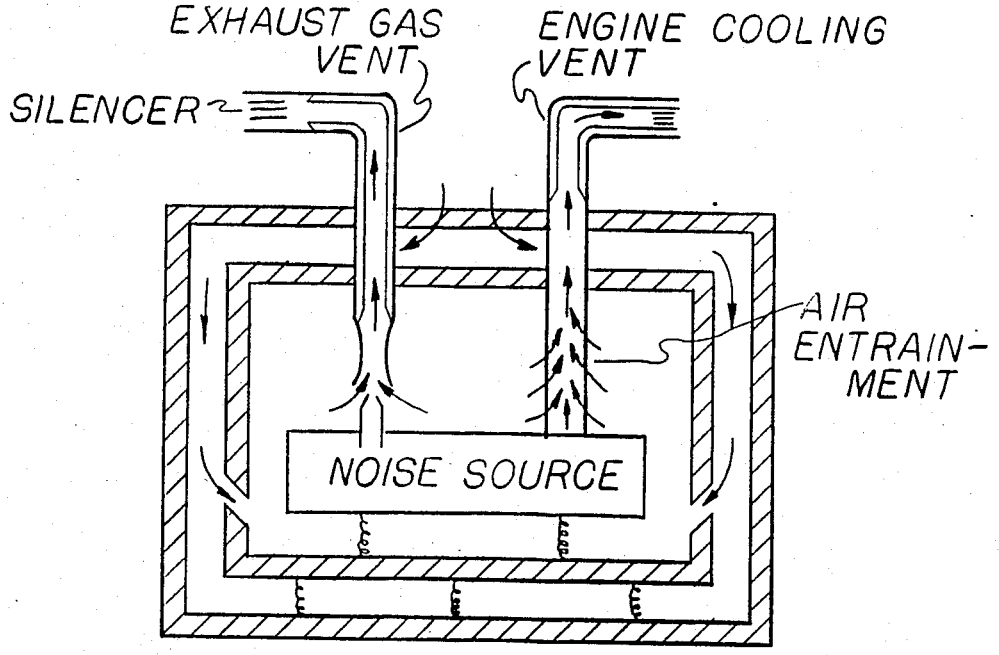

FIG. 3*b* shows a design for an engine that uses air entrainment to provide the make up pressure for the intake air friction losses. The exhaust pipe can be made into a nozzle as part of an air injector. The air injector acts as a jet pump and draws additional air through the intake slots. The air ejector is shown in FIG. 3*a*. The exhaust gas vent is lined with acoustically absorbing material and a silencer. The engine cooling vent is used to entrain air also. This vent is lined with acoustically absorbing material and a silencer. Both entrainment devices are used to provide make up pressure inside the inner encasement. This in turn provides the necessary intake air to cool the engine.

Figure 4:
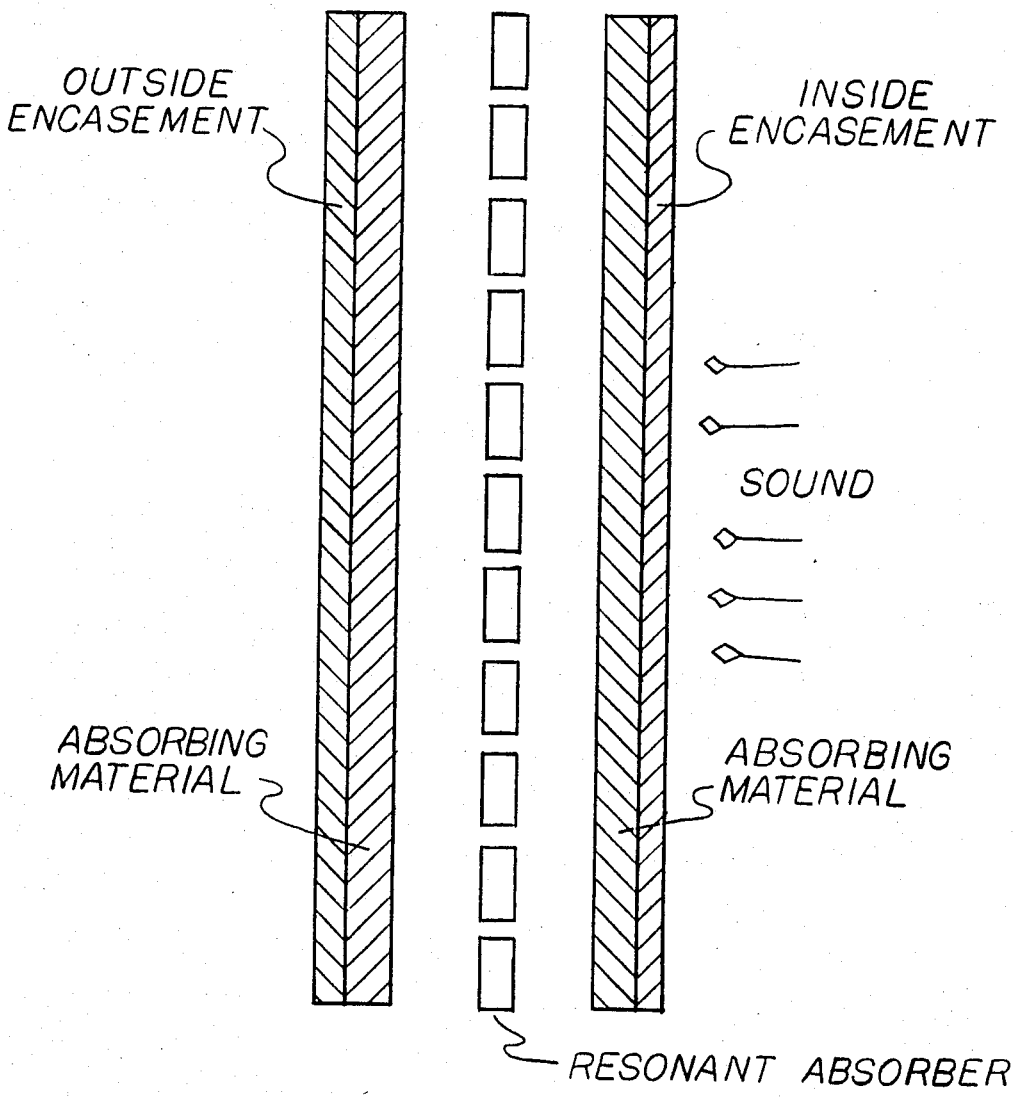
FIG. 4 shows a slotted surface placed in between the two enclosures. This slotted surface is designed for resonance absorption.

FIG. 4 shows a resonant absorber placed in the space between the two encasements. The thickness, number of holes and size of the holes can be selected to resonately absorb frequencies. This design can be used to resonately absorb the difficult low frequencies of operating engines.

I claim:

1. A sound suppressor including:

a first means for totally encasing a device generating a noise to be suppressed;

a second means encasing said first means and the noise generating device whereby a space is provided between the two encasements;

sound attenuating and absorbing material cover the outer surface of the first encasement means and the inner surface of the second encasement means;

said second means containing intake vents for communicating with the outside environment;

said first means containing vents for communicating with the space between the first and second encasements, whereby air is caused to flow from the outside of the second encasement through the intake vents thereof, through the space between the two encasements and through the vents of the first encasement into the first encasement containing the noise generating device where the air is used to cool and supply combustion to the noise generating device and is then directed out of the encasements through exhaust means associated with said device into the outside environment;

said exhaust means having a minimized opening where exiting from the encasement means for maximum sound attenuation.

2. The suppressor of claim 1, wherein the space between the first means and second means contains surfaces to resonately absorb selected acoustical frequencies.

3. The suppressor of claim 1, wherein the first encasement is vibrationally isolated from the second encasement.

4. The suppressor of claim 1, further including means for moving air from the air space between the two encasements into the volume containing the noise generating device and then using this air to cool the noise generating device and to supply combustion air, and then directing heat laden air out through the exhaust means whereby the noise generating device is cooled and prevented from overheating.

5. The apparatus of claim 1, wherein the exhaust means for the gases from the noise generating device includes a sound suppressing means interposed in the flow path of the exhaust stream consisting of at least one flow diverting means, covered internally with a sound absorbing material, for reducing the noise transmitted to the outside environment.

* * * * *